US006175704B1

(12) United States Patent
Yamamoto

(10) Patent No.: US 6,175,704 B1
(45) Date of Patent: Jan. 16, 2001

(54) ELECTROPHOTOGRAPHIC PRINTER USING REPLACEABLE PHOTOSENSITIVE BELT CARTRIDGE

(75) Inventor: Kazuoki Yamamoto, Kashiwazaki (JP)

(73) Assignee: NEC Corporation, Tokyo (JP)

( * ) Notice: Under 35 U.S.C. 154(b), the term of this patent shall be extended for 0 days.

(21) Appl. No.: 09/318,414

(22) Filed: May 25, 1999

(30) Foreign Application Priority Data

May 27, 1998 (JP) ..... 10-161498
Jun. 5, 1998 (JP) ..... 10-172111

(51) Int. Cl.[7] ..... G03G 15/02
(52) U.S. Cl. ..... 399/116; 399/162
(58) Field of Search ..... 399/116, 162, 399/164, 165; 206/303

(56) References Cited

U.S. PATENT DOCUMENTS

| | | | | |
|---|---|---|---|---|
| 3,888,577 | * | 6/1975 | Meyer | 399/116 |
| 4,655,578 | * | 4/1987 | Kurtz et al. | 399/114 |
| 4,766,455 | * | 8/1988 | Carter | 399/116 |
| 4,811,839 | * | 3/1989 | Cornell et al. | 206/303 |
| 5,034,779 | * | 7/1991 | Newbury | 399/111 |
| 5,173,733 | * | 12/1992 | Green | 399/162 X |
| 5,243,384 | * | 9/1993 | Everdyke et al. | 399/116 |
| 5,400,121 | * | 3/1995 | Foote | 399/116 |
| 5,417,322 | * | 5/1995 | Jeran et al. | 399/116 X |
| 5,708,924 | * | 1/1998 | Shogren et al. | 399/116 |
| 5,978,625 | * | 11/1999 | Park | 399/116 |
| 6,014,535 | * | 1/2000 | Zenk et al. | 399/116 |

FOREIGN PATENT DOCUMENTS

| | | |
|---|---|---|
| 55-60979 | 5/1980 | (JP) . |
| 57-64255 | 4/1982 | (JP) . |
| 61-145567 | 7/1986 | (JP) . |
| 63-148966 | 9/1988 | (JP) . |
| 1-38607 | 11/1989 | (JP) . |
| 1-38608 | 11/1989 | (JP) . |
| 1-503338 | 11/1989 | (JP) . |
| 2-66589 | 3/1990 | (JP) . |
| 2-104372 | 8/1990 | (JP) . |
| 2-234171 | 9/1990 | (JP) . |
| 5-69769 | 9/1993 | (JP) . |

(List continued on next page.)

OTHER PUBLICATIONS

2 Japanese Office Actions with English translations of the relevant portions.

*Primary Examiner*—Fred L Braun
(74) *Attorney, Agent, or Firm*—Ostrolenk, Faber, Gerb & Soffen, LLP

(57) ABSTRACT

An electrophotographic printer performs printing using a photosensitive belt wound around a belt support member. A belt cartridge is used for installation and replacement (or removal) of the photosensitive belt. Herein, the belt cartridge is constructed by an inner case and an outer case, between which the photosensitive belt being installed is held. The inner case is used to support the photosensitive belt, while the outer case is used for dust protection and light shield for the photosensitive belt and is normally stored in a storage which is provided inside or outside of a main body of the printer. At a removal mode, the outer case is inserted into the main body to be fitted to the belt support member, wherein tension applied to the photosensitive belt wound around the belt support member is released. Then, the outer case is pulled out from the main body together with the photosensitive belt. At an installation mode, the belt cartridge is inserted into the main body, wherein the outer case is fitted to the belt support member together with the photosensitive belt while the inner case remains substantially outside of the main body by being interfered by the belt support member. Then, tension is applied to the photosensitive belt wound around the belt support member. Thereafter, only the outer case is pulled out from the main body while the photosensitive belt remains inside of the main body by being installed into the belt support member.

25 Claims, 14 Drawing Sheets

FOREIGN PATENT DOCUMENTS

| | | |
|---|---|---|
| 5-257340 | 10/1993 | (JP) . |
| 8-123294 | 5/1996 | (JP) . |
| 8-231026 | 9/1996 | (JP) . |
| 8-241014 | 9/1996 | (JP) . |
| 9-281847 | 10/1997 | (JP) . |
| 9-281848 | 10/1997 | (JP) . |
| 9-281850 | 10/1997 | (JP) . |
| 10-143045 | 5/1998 | (JP) . |
| 11-52815 | 2/1999 | (JP) . |
| 11-237809 | 8/1999 | (JP) . |

* cited by examiner

ELECTROPHOTOGRAPHIC PRINTER USING REPLACEABLE PHOTOSENSITIVE BELT CARTRIDGE

BACKGROUND OF THE INVENTION

1. Field of the Invention

This invention relates to image forming apparatuses such as electrophotographic printers and electronic photocopiers using photosensitive belt cartridges, which can be replaced by users.

This application is based on Patent Application No. Hei 10-161498 and Patent Application No. Hei 10-172111 both filed in Japan, the contents of which are incorporated herein by reference.

2. Description of the Related Art

Conventionally, there are provided a variety of technologies for electrophotographic printers and electronic photocopiers (or facsimile machines) using cartridges of photosensitive belts, as follows:

The paper of Publication No. Hei 1-503338 (which discloses Japanese translation of International Patent Application No. PCT/US88/04386, International Publication No. WO89/05997) discloses a film belt loader package which uses a film belt tension support member to replace the film belt in such a way that a human operator will not directly touch a surface of the film belt being subjected to photosensitive coating.

The paper of Japanese Patent Application, Publication No. Hei 2-234171 discloses a photocopier in which a spare master drum is incorporated.

The paper of Japanese Patent Application, Publication No. Hei 10-43045 discloses a customer replaceable belt module used in an electrophotographic print machine.

The paper of Japanese Patent Application, Publication No. Hei 8-241014 discloses an electrophotographic device such as a laser printer installing a process cartridge in which an image carrier is replaced in such a way that tension applied thereto is released.

The paper of Japanese Patent Application, Publication No. Hei 11-52815 discloses a photosensitive belt storage case in which a photosensitive belt is stored between an outer wall and an inner wall on which grooves are formed respectively.

The paper of Japanese Patent Application, Publication No. Hei 5-257340 discloses a color image forming device using a process cartridge which is constructed to include a developing unit, a cleaning unit, a toner hopper and a waste toner box.

The paper of Japanese Patent Application, Publication No. Hei 8-123294 discloses a belt cartridge in which a photosensitive belt and its support members are replaced with new ones while drive rollers are maintained in the image forming device By the way, some of the electrophotographic printers use belt cartridges storing photosensitive belts. Herein, (a part of) the belt cartridge has a function in which a user is capable of removing the photosensitive belt due to deterioration of picture quality in printing because the photosensitive belt becomes (partially) unusable by the end of life. In this case, it is necessary to keep the belt cartridge or a part of the belt cartridge until the end of life of the photosensitive belt.

However, if the user keeps (a part of) the belt cartridge in some place which differs from the electrophotographic printer, there is a possibility that the user loses (a part of) the belt cartridge.

Due to reduction of the picture quality in printing or at the end of life of the photosensitive belt, a human operator (or user) needs to replace the photosensitive belt with new one. Conventionally, the electrophotographic printer is designed such that the human operator should directly grasp the photosensitive belt to replace it with new one.

However, toner powder are (electrostatically) adhered to a surface of the photosensitive belt to be replaced with new one. So, when taking out the photosensitive belt from the electrophotographic printer, the human operator dirties his or her hands with the toner powder, or the toner powder drop into the inside of the printer so as to dirty internal parts of the printer.

SUMMARY OF THE INVENTION

It is an object of the invention to provide an electrophotographic printer which the user does not lose a belt cartridge containing a photosensitive belt.

It is another object of the invention to provide a replaceable photosensitive belt cartridge, which can be replaced with ease and without dirtying internal parts of the electrophotographic printer.

According to this invention, an electrophotographic printer performs printing using a photosensitive belt wound around a belt support member. A belt cartridge is used for installation and replacement (or removal) of the photosensitive belt. Herein, the belt cartridge is constructed by an inner case and an outer case, between which the photosensitive belt being installed is held. Specifically, the photosensitive belt is stored in a storage portion, which has roughly the same dimensions (e.g., width and length) of the photosensitive belt and which is formed at an interior portion of the outer case. The inner case is used to support the photosensitive belt, while the outer case is used for dust protection and light shield for the photosensitive belt and is normally stored in a storage which is provided inside or outside of a main body of the printer. In the printer, the photosensitive belt is supported in a prescribed shape by rollers of the belt support member, wherein one of the rollers has a capability of moving in an interior direction from the photosensitive belt to refuge.

At a removal mode, the outer case is inserted into the main body through its opening and is fitted to the belt support member, wherein tension applied to the photosensitive belt wound around the belt support member is released by moving one of the rollers. Then, the outer case is pulled out from the main body together with the photosensitive belt.

At an installation mode, the belt cartridge is inserted into the main body, wherein the outer case is fitted to the belt support member together with the photosensitive belt while the inner case remains substantially outside of the main body by being interfered by the belt support member. Then, tension is applied to the photosensitive belt wound around the belt support member by moving back one of the rollers. Thereafter, only the outer case is pulled out from the main body while the photosensitive belt remains inside of the main body by being installed into the belt support member.

Incidentally, the belt support member has at least four rollers, which apply tension to the photosensitive belt and one of which is moved to release the tension. In addition, positioning is established by matching three holes of the outer case with three holes of the photosensitive belt respectively, wherein two holes are formed at positions on slants of the outer case having a flattened triangular shape while one hole is formed at a position corresponding to a center of a bottom of the outer case.

BRIEF DESCRIPTION OF THE DRAWINGS

These and other objects, aspects and embodiment of the present invention will be described in more detail with reference to the following drawing figures, of which.

DESCRIPTION OF THE PREFERRED EMBODIMENT

This invention will be described in further detail by way of examples with reference to the accompanying drawings.

Now, a description will be given with respect to construction and operation of an electrophotographic printer in accordance with the preferred embodiment of the invention. Herein, the description will be firstly given with respect to the electrophotographic printer which uses a photosensitive belt stored in a belt cartridge.

Figure 1:
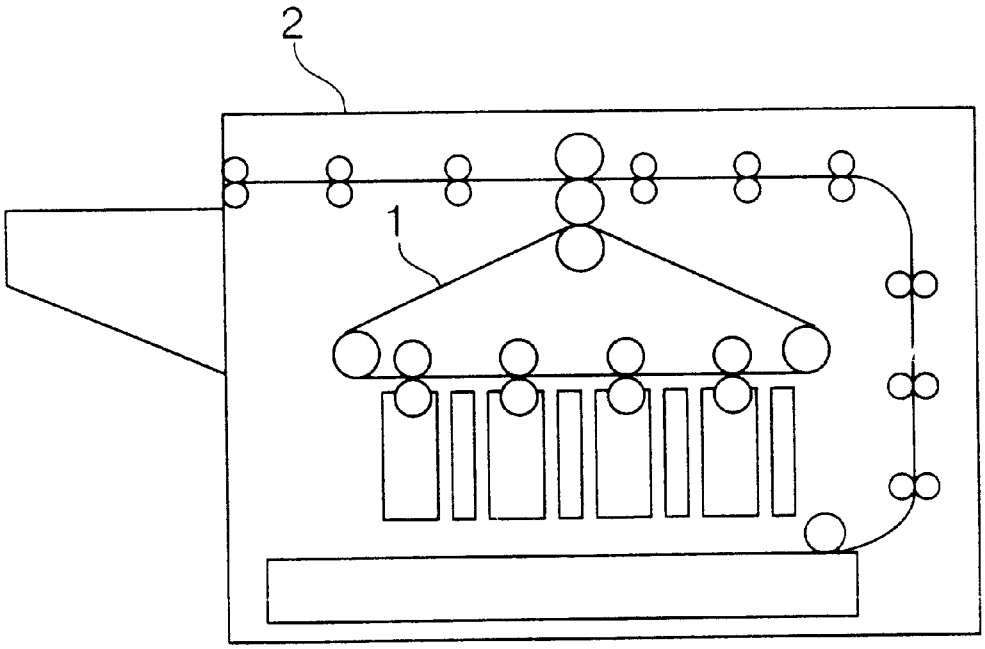
FIG. 1 is a front view partially in section showing an electrophotographic printer in accordance with the preferred embodiment of the invention.
Figure 2:
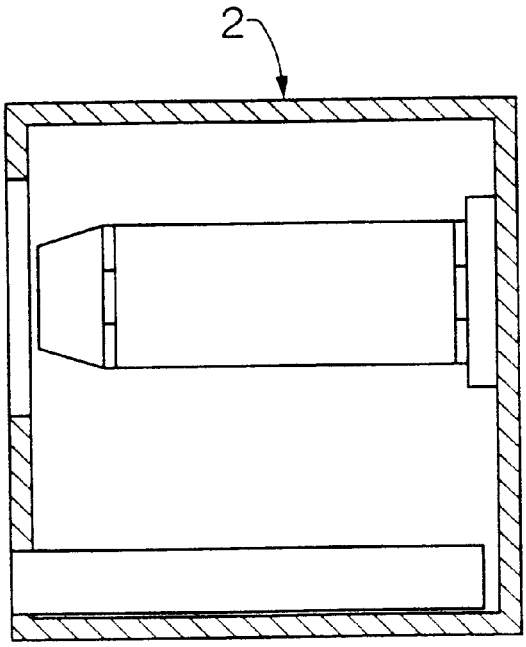
FIG. 2 is a side view showing the electrophotographic printer of FIG. 1.

FIGS. 1 and 2 are conceptual drawings showing the construction of the electrophotographic printer using the photosensitive belt. Specifically, FIG. 1 is a front view partially in section showing an electrophotographic printer 2, which will be simply referred to as a printer 2. FIG. 2 is a side view of the printer 2. As shown in FIGS. 1 and 2, a photosensitive belt 1 is arranged inside of (a main body of) the electrophotographic printer 2 in such a way that it is wound around a belt support member 5 (see FIG. 10). The electrophotographic printer 2 of FIG. 1 uses the photosensitive belt 1, which should be replaced with new one. Herein, it is necessary to protect the replaced photosensitive belt 1 against dust, while it is necessary to shield it from light. In order to do so, a belt cartridge is provided to store the photosensitive belt 1.

Figure 3:
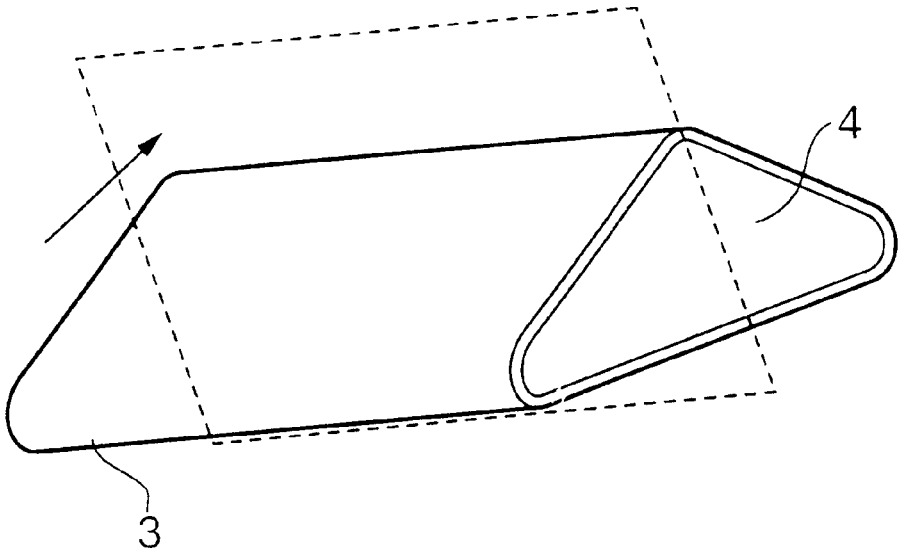
FIG. 3 is a perspective view showing a belt cartridge.
Figure 4:
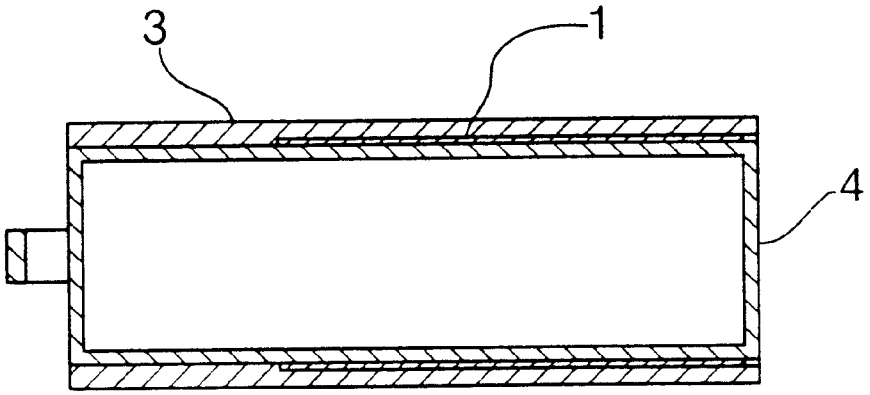
FIG. 4 is a sectional view showing an example of a construction of the belt cartridge.

FIG. 3 shows an example of the belt cartridge which stores the photosensitive belt 1. The belt cartridge of FIG. 3 is constructed by an outer case 3 and an inner case 4. FIG. 4 is a sectional view of the belt cartridge taken along a plane shown by dotted lines in FIG. 3. Specifically, FIG. 4 shows a section of the belt cartridge, which is observed from a certain viewpoint indicated by an arrow in FIG. 3 with respect to the plane of dotted lines. As shown in FIG. 4, the photosensitive belt 1 is inserted into a gap between the outer case 3 and the inner case 4. Thus, the photosensitive belt 1 is supported inside of the belt cartridge. The outer case 3 is provided for dust protection and light shield of the photosensitive belt 1. The inner case 4 is provided to support the photosensitive belt 1 within the belt cartridge.

Figure 5:
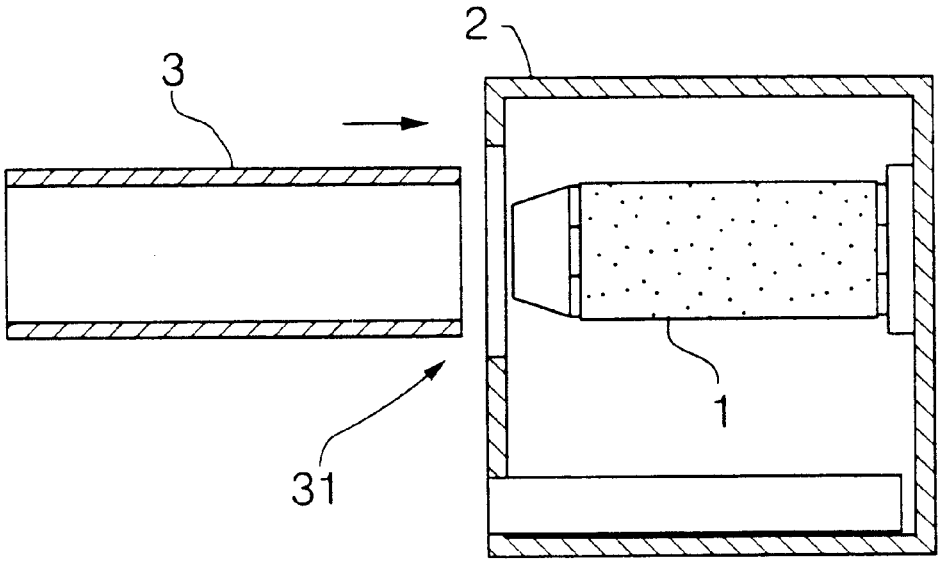
FIG. 5 is a side view partially in section showing the electrophotographic printer into which an outer case of the belt cartridge is inserted to remove a photosensitive belt.
Figure 6:
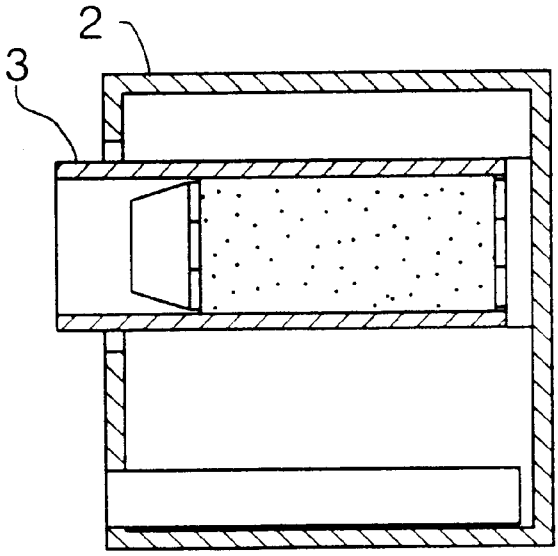
FIG. 6 is a side view partially in section showing the electrophotographic printer in which the outer case is fitted to a belt support member supporting the photosensitive belt.

Next, a description will be given with respect to functions for removing the photosensitive belt 1 by using (a part of)

the belt cartridge, wherein the photosensitive belt 1 becomes unusable by the end of life because of deterioration of picture quality in printing. In an initial state shown in FIG. 5, the photosensitive belt 1 is installed in the belt support member 5 within the printer 2. The outer case 3 is used for installation of the photosensitive belt 1. This outer case 3 is directed to match with an opening 31, which is formed at a front area of the printer 2. Then, a human operator (or user) moves the outer case 3 in a direction shown by an arrow (i.e., rightward direction in FIG. 5). So, the outer case 3 is gradually put into the opening 31 to be fitted to the belt support member 5. FIG. 6 shows a state where the outer case 3 is completely fitted to the belt support member 5.

Figure 7:
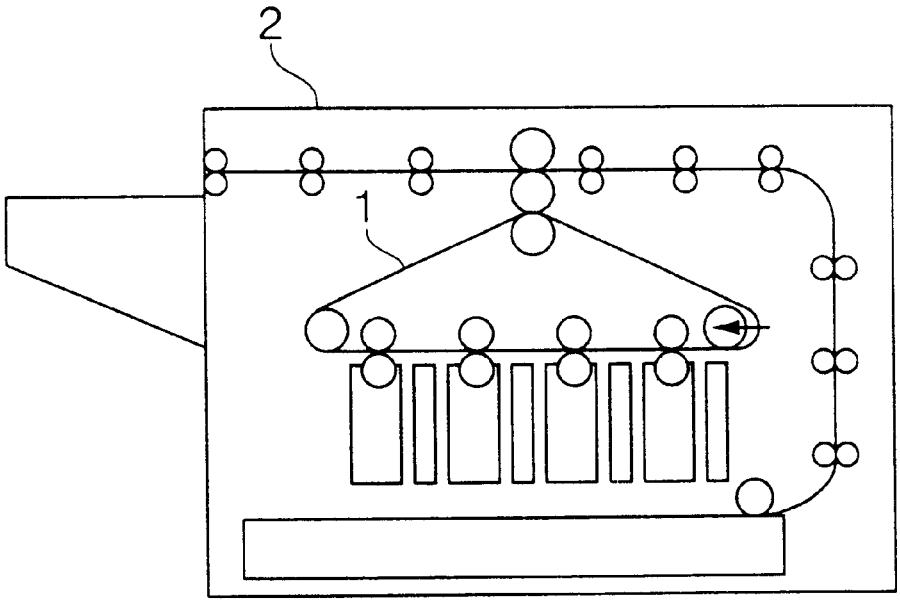
FIG. 7 is a front view partially in section showing the electrophotographic printer in which tension applied to the photosensitive belt supported by the belt support member is released.
Figure 8:
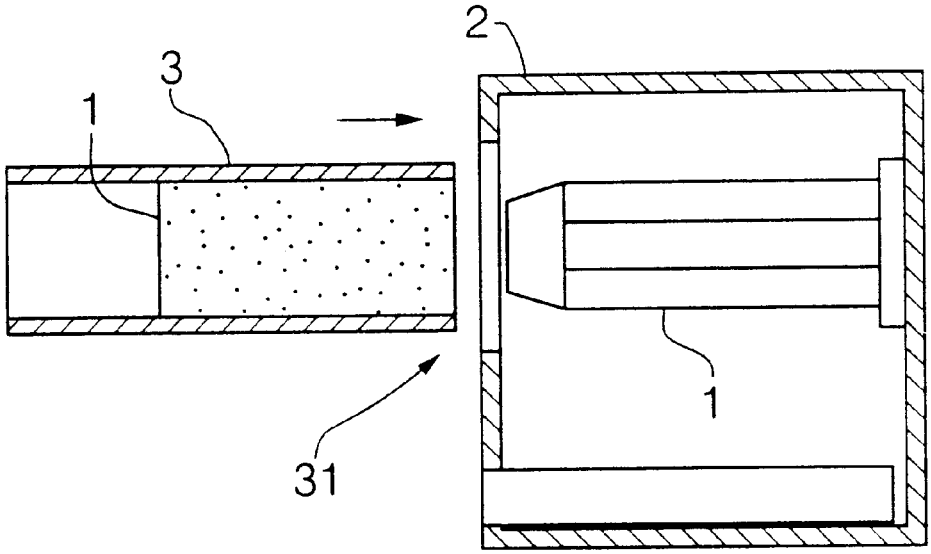
FIG. 8 is a side view partially in section wherein the photosensitive belt is removed from the electrophotographic printer together with the outer case.

As shown in FIG. 7, the belt support member 5 supporting the photosensitive belt 1 is equipped with seven rollers. Herein, one of the seven rollers is moved in a direction shown by an arrow (i.e., leftward direction of FIG. 7) to refuge. As a result, tension applied to the photosensitive belt 1 is released. Next, the outer case 3 is pulled out from the printer 3, which is shown in FIG. 8. Herein, the photosensitive belt 1 is also pulled out from the printer 2 together with the outer case 3.

In the case where (a part of) the belt cartridge has a function to remove the photosensitive belt 1, which becomes unusable by the end of life because of the deterioration of the picture quality in printing, it is necessary to keep (a part of) the belt cartridge until the end of life of the photosensitive belt 1. As described before, if the user keeps (a part of) the belt cartridge at some location which differs from the printer 2, there is a possibility that the user loses (a part of) the belt cartridge.

To avoid loss of (a part of) the belt cartridge, the present embodiment of this invention provides the printer 2 with a function to keep (a part of) the belt cartridge.

Figure 9:
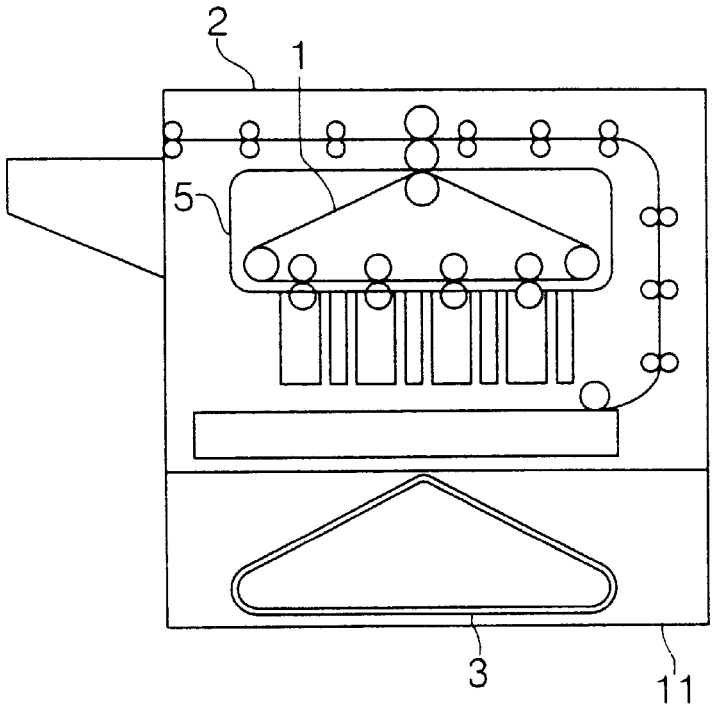
FIG. 9 is a front view partially in section showing an example of a construction of the electrophotographic printer which has a space to keep the outer case.
Figure 10:
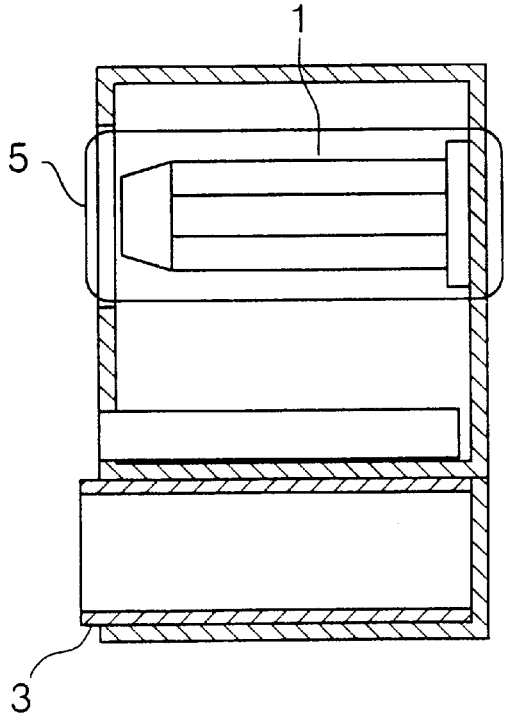
FIG. 10 is a side view partially in section showing the electrophotographic printer of FIG. 9.

FIGS. 9 and 10 show an example of the electrophotographic printer 2 which has the function to keep (a part of) the belt cartridge therein. As shown in FIGS. 9 and 10, a space 11 is provided to store the outer case 3 within the printer 2. After replacement of the photosensitive belt 1, the outer case 3 is stored in the space 11, which is formed at a lower portion of the printer 2. Therefore, at the next time to replace the photosensitive belt, the user takes out the outer case 3 from the space 11. Then, as shown in FIG. 8, the user removes the photosensitive belt 1, which becomes unusable by the end of life because of the deterioration of the picture quality in printing.

Figure 11:
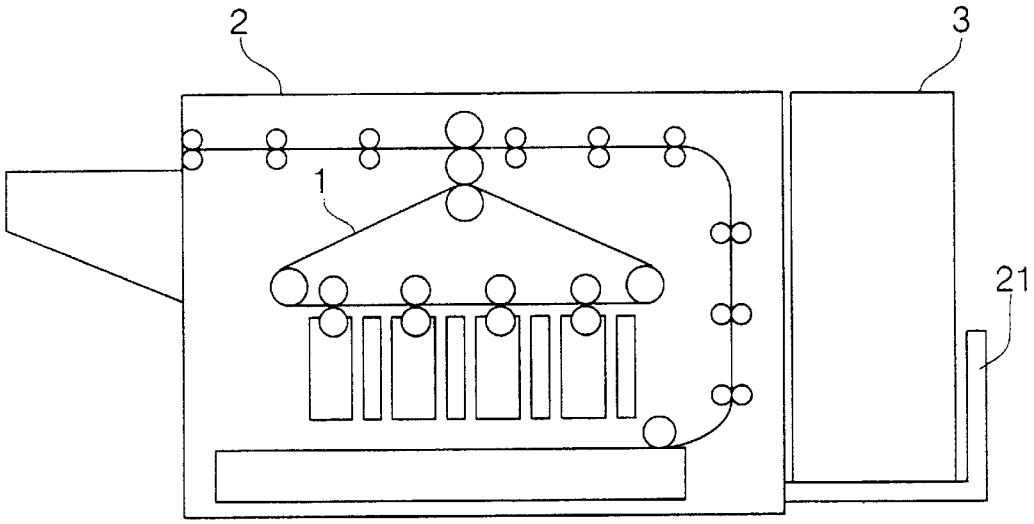
FIG. 11 is a front view partially in section showing another example of the construction of the electrophotographic printer which keeps the outer case externally.

FIG. 11 shows another example of the electrophotographic printer 2 which has a function to keep (a part of) the belt cartridge therein. In the case of FIG. 11, a space 21 for storing the outer case 3 is provided outside of the printer 2.

In this case, it is possible to provide a hook on which the outer case 3 is hooked, instead of the space 21 for storing the outer case 3. After replacement of the photosensitive belt 1, the outer case 3 is placed in the space 21 provided outside of the printer 2. Then, at the next time to replace the photosensitive belt, the user uses the outer case 3 kept in the space 21 to remove the photosensitive belt (see FIG. 8), which becomes unusable by the end of life because of the deterioration of the picture quality in printing.

As described above, in the case where (a part of) the belt cartridge has a function to remove the photosensitive belt 1, which becomes unusable by the end of life because of the deterioration of the picture quality in printing, it is necessary to keep (a part of) the belt cartridge untile the end of life of the photosensitive belt 1. The aforementioned examples show constructions of the electrophotographic printer 2, which is capable of keeping (a part of) the belt cartridge therewith. Therefore, it is possible to avoid loss of the belt cartridge.

Next, a description will be simply given with respect to procedures for pulling out the photosensitive belt 1 from the belt support member 5 by using (a part of) the belt cartridge.

Figure 12:
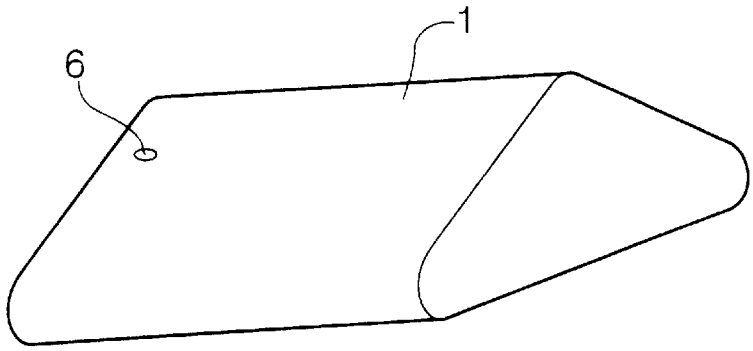
FIG. 12 is a perspective view showing the photosensitive belt having holes.
Figure 13:
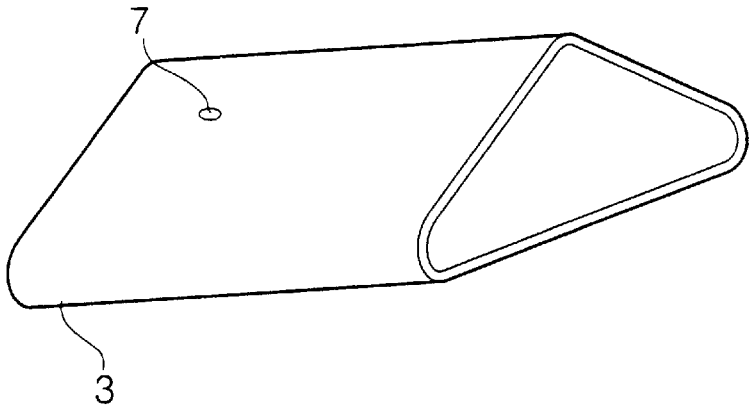
FIG. 13 is a perspective view showing the outer case having holes, which are arranged in positions to match with the holes of the photosensitive belt.

FIGS. 12 to 16 show a mechanism in which the photosensitive belt 1 is pulled out from the printer 2 together with the outer case 3 as shown in FIG. 8. Herein, FIG. 12 shows an example of a construction of the photosensitive belt 1, while FIG. 13 shows an example of a construction of the outer case 3.

As shown in FIG. 12, multiple holes 6 are formed and arranged on the photosensitive belt 1 in proximity to its edge, which is located at a front side of the printer 2. Specifically, three holes are formed on the photosensitive belt 1. In the printer 2, a position control is performed on the photosensitive belt 1 in such a way that the photosensitive belt 1 normally stops at the same position in the stop state of the printer 2 after the end of printing.

Figure 14:
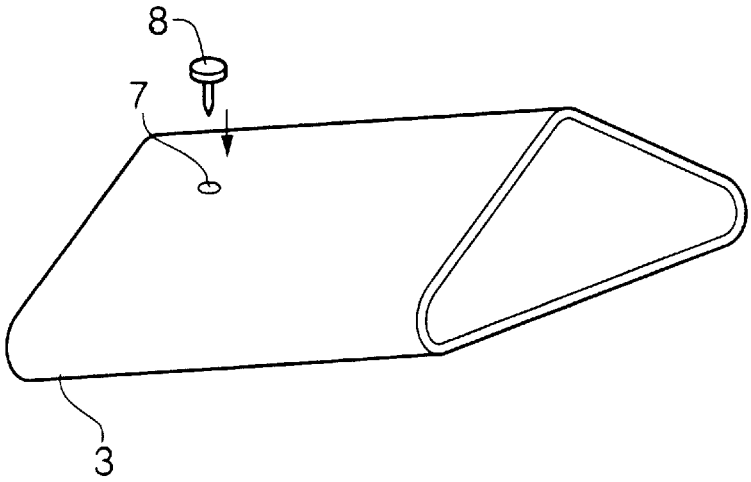
FIG. 14 is a perspective view showing the outer case having the holes into which pins are inserted.

As shown in FIG. 13, multiple holes 7 are formed and arranged on the outer case 3 in positions to match with the holes 6 of the photosensitive belt 1. Herein, a number of the holes 7 corresponds to a number of the holes 6. When removing the photosensitive belt 1 which becomes unusable by the end of life because of the deterioration of the picture quality in printing, the user inserts pins 8 into the holes 7 of the outer case 3, which is shown in FIG. 14.

Figure 15:
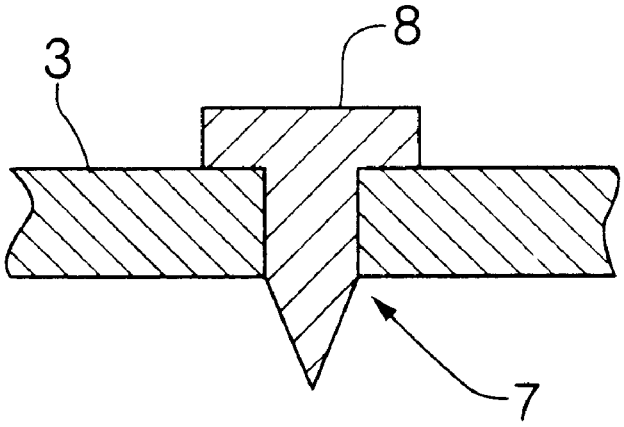
FIG. 15 is a sectional view showing a selected part of the outer case with regard to the hole into which the pin is inserted.
Figure 16:
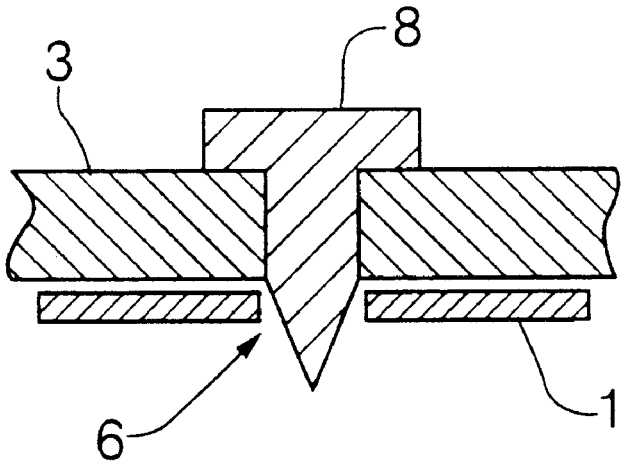
FIG. 16 is a sectional view showing selected parts of the outer case and photosensitive belt with regard to their holes into which the pin is inserted.

FIG. 15 is a sectional view showing a selected part of the outer case 3 in proximity to the hole 7. Herein, a tip portion of the pin 8 projects downwardly from an inner wall of the outer case 3. Under such a state where the pins 8 are inserted into the holes 7 of the outer case 3 in such a way that tip portions thereof project downwardly from the inner wall of the outer case 3, the outer case 3 is inserted into the opening 31 of the printer 2 and is then fitted to the belt support member 5 as shown in FIG. 6. As described before, the holes 7 of the outer case 3 are arranged in positions to match with the holes 6 of the photosensitive belt 1. So, the tip portions of the pins 8 are respectively inserted and fitted into the holes 6 of the photosensitive belt 1 as shown in FIG. 16.

Under the aforementioned state where the pins 8 are inserted into the holes 7 of the outer case 3 and the holes 6 of the photosensitive belt 1 respectively, one of the rollers of the belt support member 5 is moved in the foregoing direction of the arrow to refuge, which have been described before with reference to FIG. 7. Thus, it is possible to release the tension applied to the photosensitive belt 1. Then, the outer case 3 is pulled out from the printer 2 as shown in FIG. 8. Thus, it is possible to remove the photosensitive belt 1 together with the outer case 3 from the printer 2.

Figures 17A, 17B, 17C:
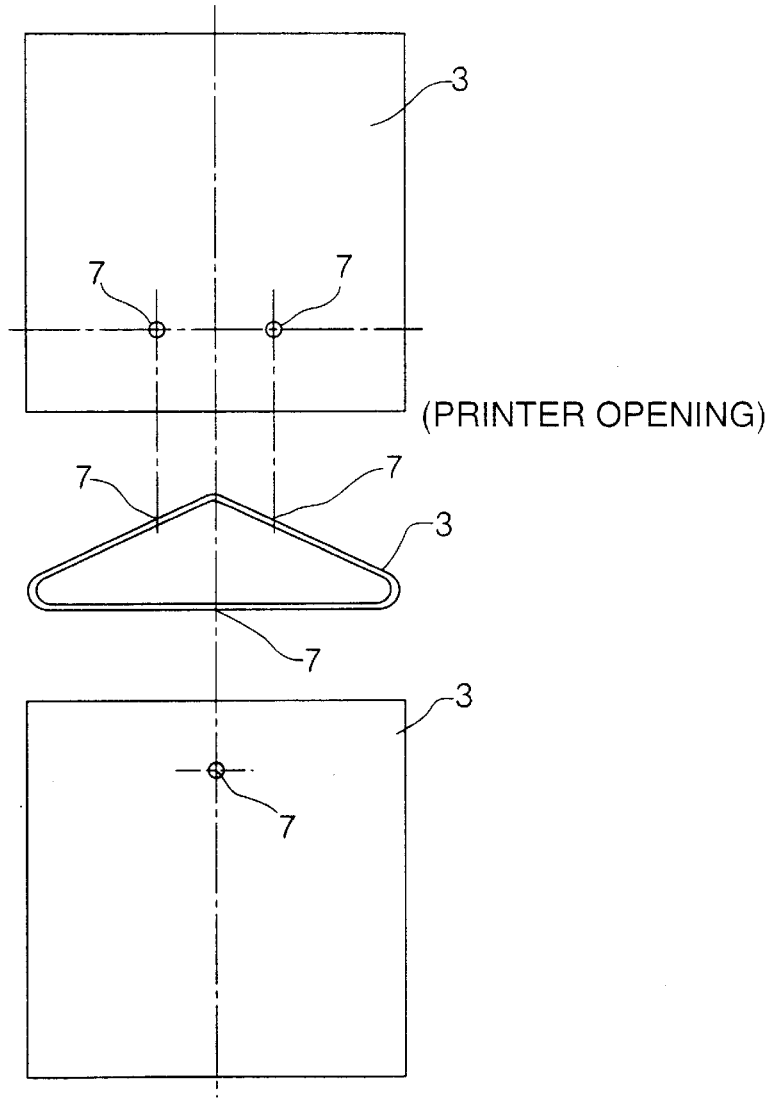
FIG. 17A is a plan view of the outer case on which holes are formed at prescribed positions.
FIG. 17B is a front view of the outer case.
FIG. 17C is a bottom view of the outer case on which a hole is formed at a prescribed position.

Incidentally, the outer case 3 as a whole is formed like a flattened triangular shape, whose section corresponds to a flattened triangle (see FIG. 17B). For example, FIGS. 17A, 17B and 17C show three positions to form three holes 7 on the outer case 3. That is, two holes 7 are respectively formed at positions located on slants of the outer case 3 (see FIGS. 17A and 17B) in proximity to the opening 31 of the printer 2. In addition, another hole 7 is formed at a position located at a center of a bottom of the outer case 3 (see FIGS. 17B and 17C) in proximity to the opening 31 of the printer 2.

As described heretofore, it is possible to remove the photosensitive belt 1 from the printer 2 by using (a part of) the belt cartridge.

Figure 18:
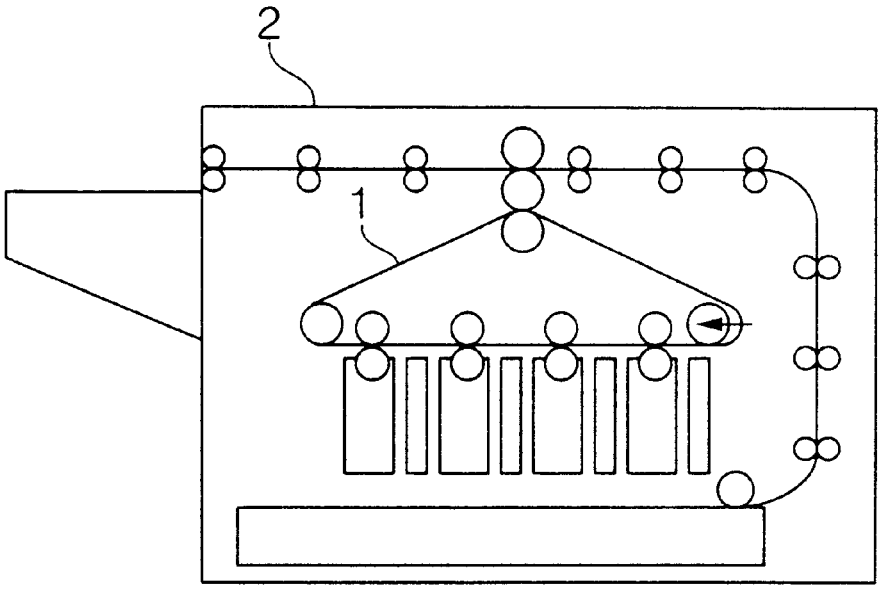
FIG. 18 is a front view partially in section of an electrophotographic printer wherein tension applied to a photosensitive belt is released by moving one of rollers of a belt support member.
Figure 19:
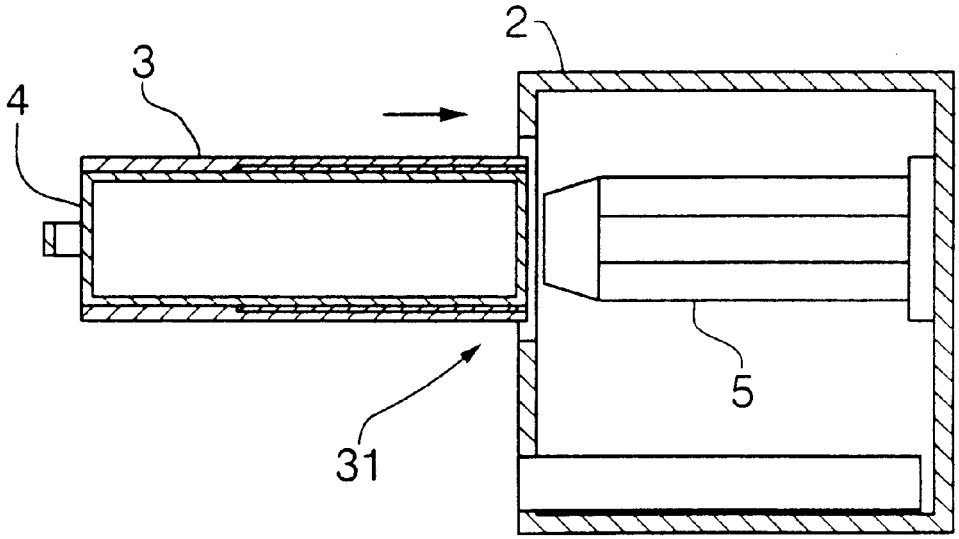
FIG. 19 is a side view partially in section of the electrophotographic printer in which a belt cartridge having a new photosensitive belt is directed to an opening.

Thereafter, the photosensitive belt 1 is replaced with new one, which is installed into the printer 2 in accordance with procedures, as follows:

Installation of the new photosensitive belt "1" into the printer 2 will be described with reference to FIGS. 18 to 22. As shown in FIG. 18, one of the rollers of the belt support member 5 is moved in a direction of an arrow (i.e., leftward direction) to refuge. Then, positioning is performed as shown in FIG. 19, wherein the belt cartridge is directed to the opening 31 of the printer 2 in such a way that it can be inserted and fitted to the belt support member 5 within the printer 2.

Figure 20:
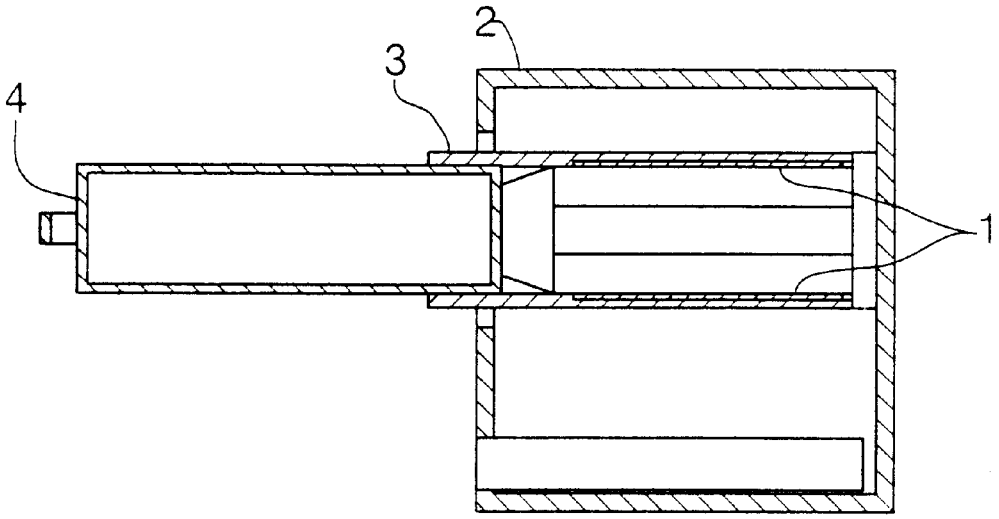
FIG. 20 is a side view partially in section of the electrophotographic printer in which an outer case of the belt cartridge is inserted and fitted to the belt support member together with the new photosensitive belt while an inner case substantially remains outside.

As shown in FIG. 20, the user holds the belt cartridge to be inserted into the opening 31 of the printer 2 so that the belt cartridge will be fitted to the belt support member 5. In this case, the inner case 4 of the belt cartridge interferes with the belt support member 5, so that the outer case 3 is fitted to the belt support member 5 together with the "new" photosensitive belt 1.

Figure 21:
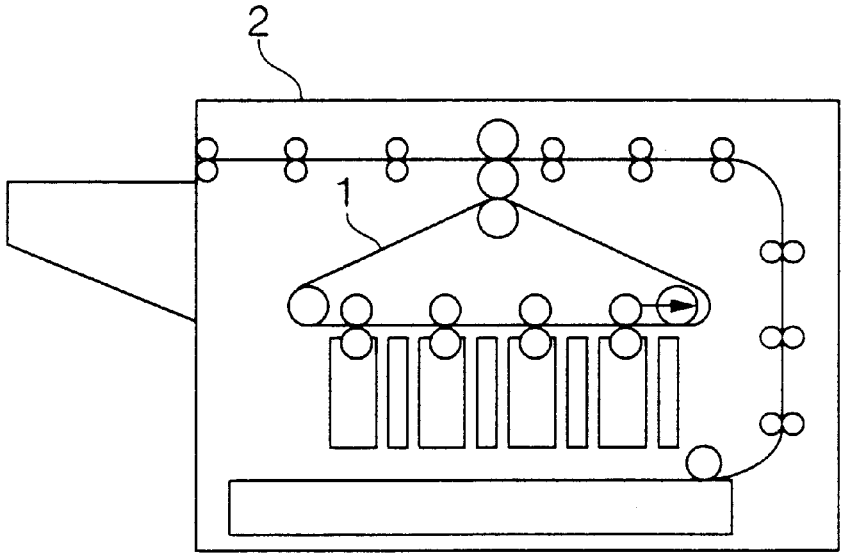
FIG. 21 is a front view partially in section of the electrophotographic printer in which one of the rollers of the belt support member is moved backward so that tension is applied to the new photosensitive belt newly installed into the belt support member.

After completion of insertion that the outer case 3 completely fits with the belt support member 5 together with the photosensitive belt 1, the user pulls out the inner case 4. Then, one of the rollers of the belt support member, which has been moved in the leftward direction in FIG. 18 to refuge, is moved backwardly as shown in FIG. 21. As a result, tension is applied to the photosensitive belt 1, which is fixedly installed with the belt support member 5.

Figure 22:
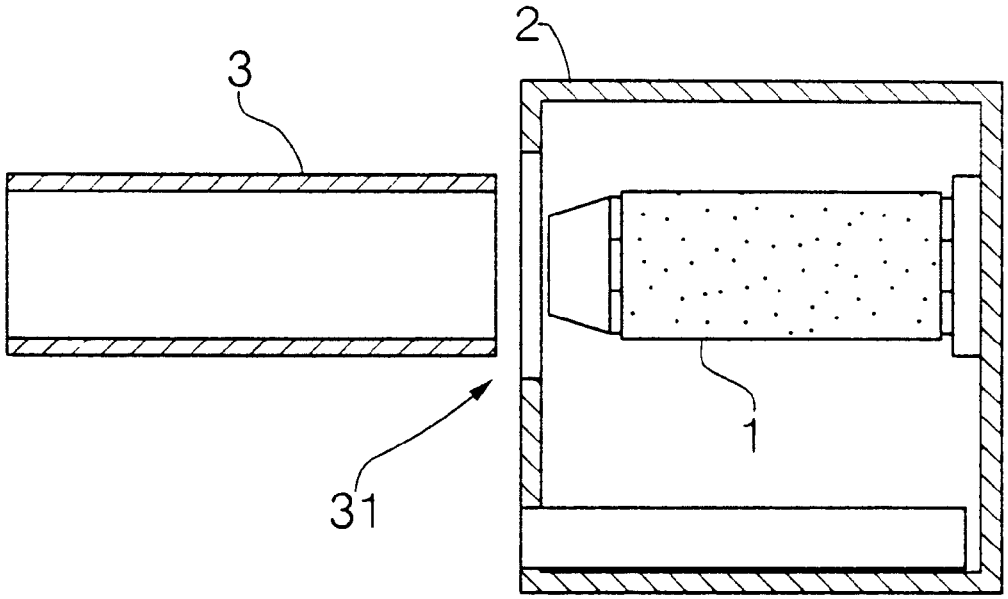
FIG. 22 is a side view partially in section of the electrophotographic printer in which the outer case is pulled out while the new photosensitive belt remains inside to be installed into the belt support member.

Lastly, the user pulls out the outer case 3 from the belt support member 5 as shown in FIG. 22. Thus, the photosensitive belt 1 remains with the belt support member 5 in the printer 2.

As described above, the photosensitive belt 1 is installed into the printer 2. This enables the printer 2 to start printing.

Incidentally, the aforementioned examples of the printer 2 are designed such that (a part of) the belt cartridge is stored in the lower portion of the printer 2. However, this invention is not limited to such examples. Hence, it is possible to arbitrarily select the location to store (a part of) the belt cartridge with respect to the printer 2.

In addition, the aforementioned belt support member 5 is constructed using the seven rollers. However, the belt support member can be redesigned to have a small number of rollers, which is four or more, for example.

Further, it is possible to redesign the belt cartridge such that the aforementioned pins are replaced with projections.

Next, a description will be given with respect to a belt cartridge "C" with reference to FIGS. 23A, 23B and FIGS. 24A, 24B, 24C and 24D.

Figure 23A:
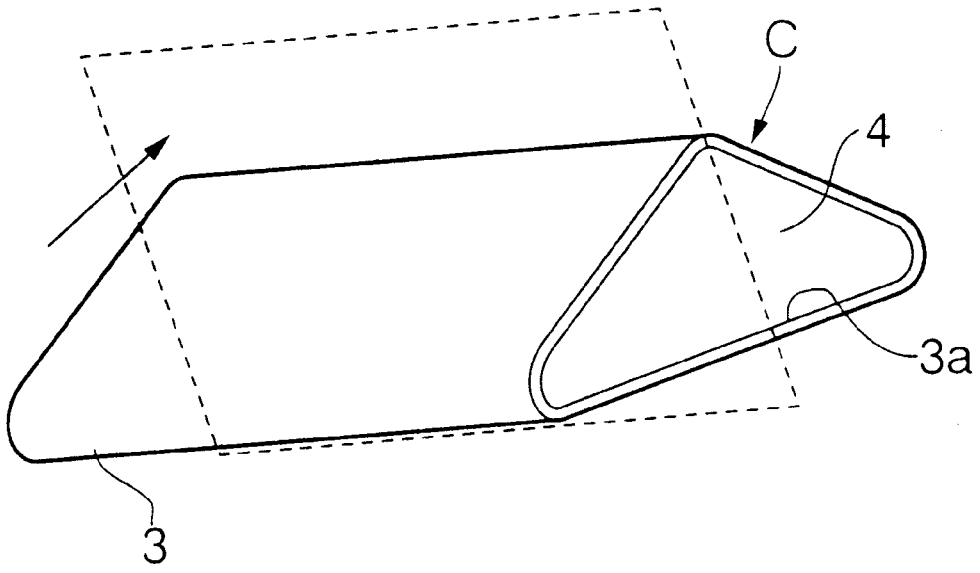
FIG. 23A is a perspective view showing an appearance of a belt cartridge.
Figure 23B:
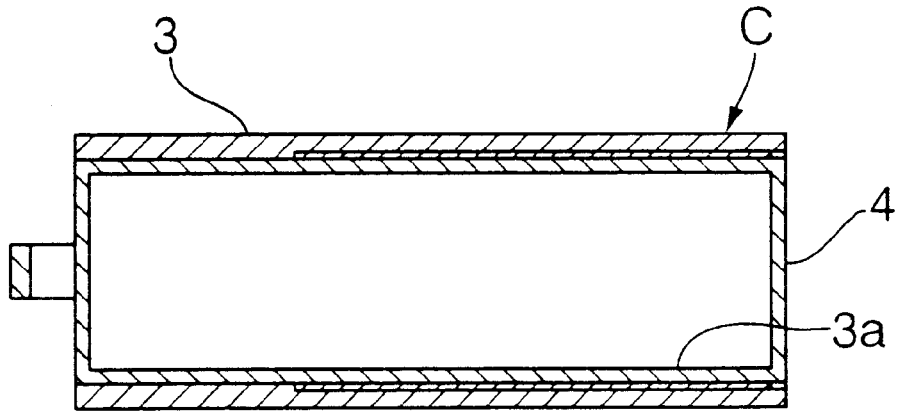
FIG. 23B is a sectional view of the belt cartridge.

As shown in FIG. 23A, the belt cartridge C is constructed by the outer case 3 and the inner case 4. In addition, the photosensitive belt 1 is inserted into a gap between the outer case 3 and the inner case 4, which is shown in FIG. 23B. Herein, the outer case 3 has a storage portion 3*a* which stores the photosensitive belt 1 therein and which has roughly the same dimensions such as width and length of the photosensitive belt 1. The photosensitive belt 1 is located in a prescribed position of the outer case 3 in such a way that one end of the photosensitive belt 1 is brought in contact with an interior end portion of the storage portion 3*a* of the outer case 3.

Figure 24A:
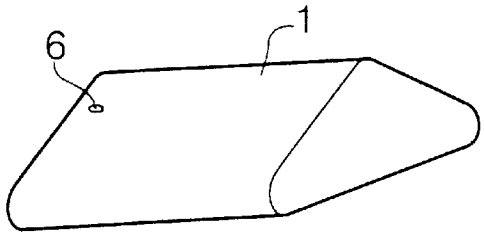
FIG. 24A is a perspective view showing a photosensitive belt.
Figure 24B:
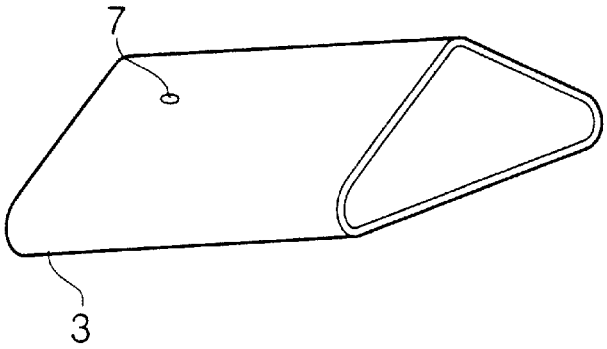
FIG. 24B is a perspective view showing an outer case storing the photosensitive belt.
Figure 24C:
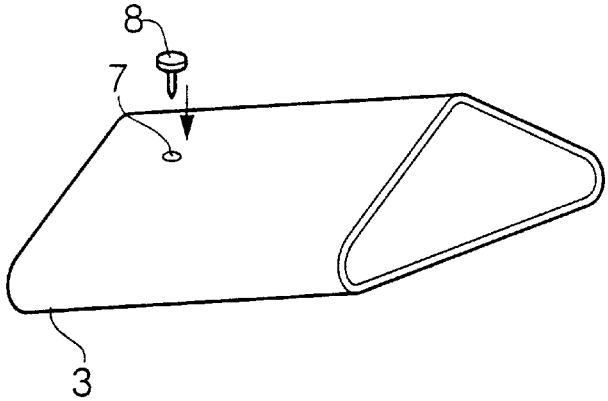
FIG. 24C is a perspective view showing the outer case having a hole into which a pin is to be inserted.
Figure 24D:
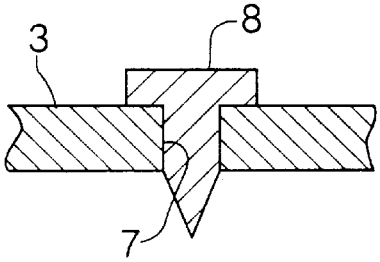
FIG. 24D is a sectional view showing a selected part of the outer case in which the pin is inserted into the hole.
Figure 24E:
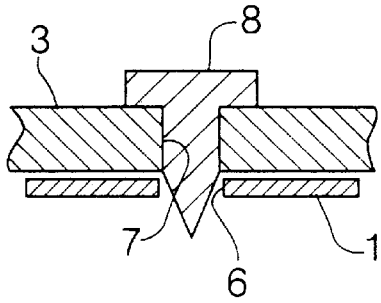
FIG. 24E is a sectional view showing selected parts of the outer case and photosensitive belt in which the pin penetrates through holes respectively.

A hole 7 (see FIGS. 24B and 24C) is formed at a prescribed position in relation to the storage portion 3*a* of the outer case 3. In addition, a hole 6 (see FIGS. 24A and 24E) is formed on the photosensitive belt 1. Herein, a position of the hole 6 is determined to match with the hole 7 of the outer case 3 under the condition where the photosensitive belt 1 is stored in the storage portion 3*a* of the outer case 3. Under such condition, a pin 8 is inserted into the hole 7 of the outer case 3, which is shown in FIGS. 24C and 24D. Thus, a tip portion of the pin 8 penetrates through the hole 7 of the outer case 3, then, it fits with the hole 6 of the photosensitive belt 1. Thus, as shown in FIG. 24E, the photosensitive belt 1 is fixed to the interior wall (or storage portion 3*a*) of the outer case 3.

Incidentally, as shown in FIGS. 17A, 17B and 17C, three holes "7" are formed on the outer case 3, while three holes "6" are correspondingly formed on the photosensitive belt 1.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to be embraced by the claims.

What is claimed is:

1. An image forming apparatus comprising:

main body for using a photosensitive belt in formation of pictures being printed;

a belt cartridge used for removal and replacement of the photosensitive belt within the main body; and a storage provided inside of the main body or connected to an outside of the main body for storing at least a part of the belt cartridge.

2. An image forming apparatus according to claim 1 wherein the storage is provided inside of the main body.

3. An image forming apparatus according to claim 1 wherein the storage is connected to an outside of the main body.

4. An image forming apparatus according to claim 1 wherein the belt cartridge is constructed by a first outer case used for light shield of the photosensitive belt being replaced and a second inner case for supporting the photosensitive belt.

5. An image forming apparatus according to claim 1 wherein at least one hole is formed on the photosensitive belt.

6. An image forming apparatus according to claim 1 wherein the belt cartridge is constructed by a first outer case used for light shield of the photosensitive belt and a second inner case for supporting the photosensitive belt, and wherein the storage is used to store the first case.

7. An image forming apparatus according to claim 1 wherein the belt cartridge is used only when the photosensitive belt becomes unusable by an end of life because of deterioration of picture quality in printing.

8. An image forming apparatus comprising:

a main body for using a photosensitive belt in formation of pictures being printed;

a belt cartridge used for removal and replacement of the photosensitive belt within the main body: and a storage for storing at least a part of the belt cartridge wherein at least one hole is formed on the photosensitive belt while the belt cartridge is equipped with at least one projection to match with at least one hole of the photosensitive belt.

9. A replaceable photosensitive belt cartridge comprising:

an inner case for supporting a photosensitive belt in a prescribed form, wherein the inner case is inserted into an interior space of the photosensitive belt; and an outer case for covering the photosensitive belt, wherein the outer case is detachably attached to the inner case equipped with the photosensitive belt, wherein a storage portion for storing the photosensitive belt therein is formed at an interior portion of the outer case, and wherein at least one hole is formed at a position in the storage portion of the outer case, while a hole is formed on the photosensitive belt at a position which matches with the hole of the outer case fitted with the photosensitive belt.

10. A replaceable photosensitive belt cartridge according to claim 9 further comprising a pin which is fitted to the hole of the outer case and the hole of the photosensitive belt respectively so that the photosensitive belt is fixed inside of the outer case.

11. A replaceable photosensitive belt cartridge comprising:

an inner case for supporting a photosensitive belt in a prescribed form, wherein the inner case is inserted into an interior space of the photosensitive belt; and an outer case for covering the photosensitive belt, wherein the outer case is detachably attached to the inner case equipped with the photosensitive belt, wherein a storage portion having roughly same dimensions such as width and length of the photosensitive belt is formed at an interior portion of the outer case, wherein one end of the photosensitive belt fits with an interior end portion of the storage portion, wherein a storage portion for storing the photosensitive belt therein is formed at an interior portion of the outer case, and wherein at least one hole is formed at a position in the storage portion of the outer case, while a hole is formed on the photosensitive belt at a position which matches with the hole of the outer case fitted with the photosensitive belt.

12. A replaceable photosensitive belt cartridge according to claim 11 further comprising a pin which is fitted to the hole of the outer case and the hole of the photosensitive belt respectively so that the photosensitive belt is fixed inside of the outer case.

13. An electrophotographic printer comprising:

a photosensitive belt which is replaceable;

a belt support member for supporting the photosensitive belt in a prescribed shape by applying tension to the photosensitive belt;

tension adjustment means for adjusting the tension applied to the photosensitive belt wound around the belt support member; and a storage provided inside of the main body or connected to an outside of the main body for storing a replacement photosensitive belt.

14. An electrophotographic printer according to claim 13 further comprising an opening formed at an area which communicates with the belt support member and through which the photosensitive belt can be installed or removed.

15. An electrophotographic printer according to claim 14 wherein the belt support member is constructed using a plurality of rollers which are located inside of the photosensitive belt to support the photosensitive belt in the prescribed shape.

16. An electrophotographic printer according to claim 15 wherein the tension adjustment means is constructed using at least one of the plurality of rollers which has a capability of moving in an interior direction from the photosensitive belt to remove tension from the photosensitive belt.

17. An electrophotographic printer according to claim wherein the belt support member is constructed using a plurality of rollers which are located inside of the photosensitive belt to support the photosensitive belt in the prescribed shape.

18. An electrophotographic printer according to claim 17 wherein the tension adjustment means is constructed using at least one of the plurality of rollers which has a capability of moving in an interior direction from the photosensitive belt to remove tension from the photosensitive belt.

19. An electrophotographic printer comprising:

a main body having an opening;

a belt support member installed inside of the main body, the belt support member being equipped with tension control means;

a photosensitive belt which is wound around the belt support member under tension applied thereto by the tension control means;

a belt cartridge used for replacement of the photosensitive belt, wherein the belt cartridge including an outer case and an inner case, between which a new photosensitive belt is held, is normally provided outside of the main body but is directed to match with the opening of the main body in order to remove or replace the photosensitive belt; and a storage provided inside of the main body or connected to an outside of the main body for storing the outer case of the belt cartridge, wherein the photosensitive belt is removed from and installed into the belt support member together with the outer case of the belt cartridge under a condition where the tension control means releases tension applied to the photosensitive belt.

20. An electrophotographic printer according to claim 19 wherein the storage is formed at a lower portion of the main body.

21. An electrophotographic printer according to claim 19 wherein the storage is formed as a hook arranged outside of the main body.

22. An electrophotographic printer according to claim 19 wherein the tension control means is constructed by at least four rollers, which are arranged to held the photosensitive belt installed with the belt support member under tension and one of which is moved to release the tension applied to the photosensitive belt.

23. An electrophotographic printer comprising:

a main body having an opening;

a belt support member installed inside of the main body, the belt support member being equipped with tension control means;

a photosensitive belt which is wound around the belt support member under tension applied thereto by the tension control means;

a belt cartridge used for replacement of the photosensitive belt, wherein the belt cartridge including an outer case and an inner case, between which a new photosensitive belt is held. is normally provided outside of the main body but is directed to match with the opening of the main body in order to remove or replace the photosensitive belt; and a storage for storing the outer case of the belt cartridge, wherein the photosensitive belt is removed from and installed into the belt support member together with the outer case of the belt cartridge under a condition where the tension control means releases tension applied to the photosensitive belt, wherein positioning is established by matching at least three holes of the outer case with at least three holes of the photosensitive belt respectively, wherein two holes are formed at positions on slants of the outer case having a flattened triangular shape while one hole is formed at a position corresponding to a center of a bottom of the outer case.

24. A method for removing a photosensitive belt from a main body of an electrophotographic printer, comprising the steps of:

directing an outer case of a belt cartridge to match with an opening of the main body;

inserting the outer case into the opening of the main body;

moving the outer case to be fitted to a belt support member within the main body;

releasing tension applied to the photosensitive belt wound around the belt support member; and pulling out the outer case together with the photosensitive belt from the belt support member of the main body.

25. A method for installing a photosensitive belt into a main body of an electrophotographic printer, comprising the steps of:

directing a belt cartridge, consisting of an outer case and an inner case between which the photosensitive belt is held, to match with an opening of the main body;

inserting the belt cartridge into the opening of the main body toward a belt support member;

moving the belt cartridge in such a way that the outer case is fitted to the belt support member together with the photosensitive belt while the inner case remains substantially outside of the main body by being interfered by the belt support member;

applying tension to the belt support member installed into the belt support member; and pulling out the outer case from the main body while the photosensitive belt remains to be installed with the belt support member under the tension.

* * * * *